US008047789B1

(12) United States Patent
Liang

(10) Patent No.: US 8,047,789 B1
(45) Date of Patent: Nov. 1, 2011

(54) TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1047 days.

(21) Appl. No.: 11/975,673

(22) Filed: Oct. 19, 2007

(51) Int. Cl.
*F01D 5/08* (2006.01)

(52) U.S. Cl. ..... 416/97 R

(58) Field of Classification Search ..... 416/96 R, 416/97 R, 96 A, 97 A, 231 R; 415/115
See application file for complete search history.

(56) References Cited

U.S. PATENT DOCUMENTS 2,920,866 A * 1/1960 Spurrier ..... 416/92
3,240,468 A * 3/1966 Watts et al. ..... 415/117
3,644,059 A * 2/1972 Bryan ..... 416/97 R
3,647,316 A 3/1972 Moskowitz
3,656,863 A 4/1972 De Feo
3,658,439 A 4/1972 Kydd
3,706,508 A 12/1972 Moskowitz et al.
3,732,031 A 5/1973 Bowling et al.
4,017,210 A 4/1977 Darrow
4,473,336 A 9/1984 Coney et al.
5,328,331 A 7/1994 Bunker et al.
5,419,039 A 5/1995 Auxier et al.
5,626,462 A 5/1997 Jackson et al.
5,820,337 A 10/1998 Jackson et al.
6,511,293 B2 * 1/2003 Widrig et al. ..... 416/96 R
6,726,444 B2 4/2004 Zhao et al.
6,773,230 B2 * 8/2004 Bather et al. ..... 416/97 R
7,080,971 B2 7/2006 Wilson et al.

* cited by examiner

*Primary Examiner* — Christopher Verdier
*Assistant Examiner* — Jesse Prager
(74) *Attorney, Agent, or Firm* — John Ryznic

(57) ABSTRACT

A turbine airfoil for use in a gas turbine engine, the airfoil formed from a support spar with a leading edge rib having a row of impingement cooling holes, the support spar having an array of modules formed on the pressure side and the suction side of the spar, and a number of cavities separated by ribs extending across the walls of the support spar. Each module is rectangular in shape and includes an impingement compartment and a diffusion compartment separated by a rib with crossover holes to connect the two compartments. Impingement holes connect the impingement compartment to a first cavity, and spent air cooling holes connect the diffusion compartment to a second cavity located downstream from the first cavity.

16 Claims, 4 Drawing Sheets

TURBINE AIRFOIL

BACKGROUND OF THE INVENTION

1. Field of the Invention

The present invention relates generally to an air cooled turbine airfoil, and more specifically to a turbine airfoil with near wall cooling.

2. Description of the Related Art Including Information Disclosed Under 37 CFR 1.97 and 1.98

In a gas turbine engine, especially an industrial gas turbine engine, a high temperature gas flow is passed through a turbine to produce mechanical power to drive a bypass fan in the case of an aero engine or to drive a generator in the case of the industrial engine. The efficiency of the engine can be increased by passing a higher temperature gas flow into the turbine. However, the highest temperature attainable is dependant upon several factors such as the material properties of the turbine and the cooling ability of the airfoils.

The first stage turbine stator vanes and rotor blades are exposed to the highest gas flow temperature in the engine, and therefore require the most cooling. In the prior art, near wall cooling is used in the airfoil main body that have radial flow channels plus re-supply holes in series with film discharge cooling holes. FIG. 1 shows a prior art turbine blade and FIG. 2 shows a cross section of the internal cooling channels and film discharge holes. In the cooling circuit of FIG. 2, spanwise and chordwise cooling flow control due to airfoil external hot gas temperature and pressure variation is difficult to achieve. Also, use of single radial channel flow is not the best method of utilizing cooling air since this results in a low convective cooling design.

It is an object of the present invention to provide for an air cooled turbine airfoil with a reduced airfoil main body metal temperature which results in reduced airfoil cooling flow requirement and improved turbine efficiency.

BRIEF SUMMARY OF THE INVENTION

The air cooled turbine airfoils of the present invention includes an airfoil spar having an array of rectangular shaped cavities on the pressure and suction sides of the spar. Each cavity is separated by a vertical rib into an impingement sub-cavity and a diffusion sub-cavity. The impingement sub-cavity is connected to the diffusion sub-cavity by a plurality of cross-over holes formed in the vertical separation rib. A plurality of metering and impingement holes connect a cooling air supply channel formed within the walls of the spar to the impingement sub-cavity, and a plurality of spent air return holes connects the diffusion sub-cavity to a collector channel formed within the walls of the spar. A near wall thermal skin is placed over the airfoil spar to form the pressure side wall, the suction side wall and the leading edge of the airfoil. The thermal skin includes a plurality of micro pin fins formed on the inner surface of the skin and arranged to be located in each of the cavities on the pressure and suction sides and within the leading edge of the airfoil. Cooling air impinged onto the backside of the thermal skin will produce impingement cooling. The micro pin fins will improve the convective cooling effectiveness. In order to more effectively control the metal temperature of the airfoil, each cavity can have the metering holes customized to regulate the cooling air flow and therefore the cooling rate within the particular cavity.

DETAILED DESCRIPTION OF THE INVENTION

The present invention is directed toward a turbine blade used in an industrial gas turbine engine, but can also be used in stator vanes or in rotor blades and stator vanes in an aero gas turbine engine. Any turbine airfoil that requires impingement and film cooling can make use of the inventive concepts described in the present invention.

Figure 3:
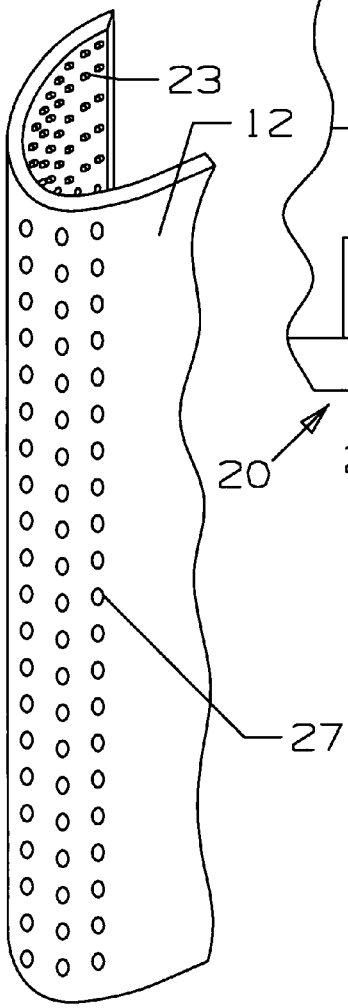
FIG. 3 shows a schematic view of the thermal skin for the leading edge of the present invention.

FIG. 3 shows the leading edge region of a thermal skin 12 used to cover the airfoil spar 11 of the turbine blade and form the airfoil surfaces on the pressure side, the suction side and the leading edge of the blade. The thin thermal skin 12 includes a showerhead arrangement of film cooling holes 27 arranged along the leading edge to discharge cooling air from the leading edge cavity formed between the spar 11 and the thin thermal skin 12. On the inner surface of the thermal skin 12 is a plurality of micro pin fins 23 that function to improve the convective cooling of the airflow.

Figure 6:
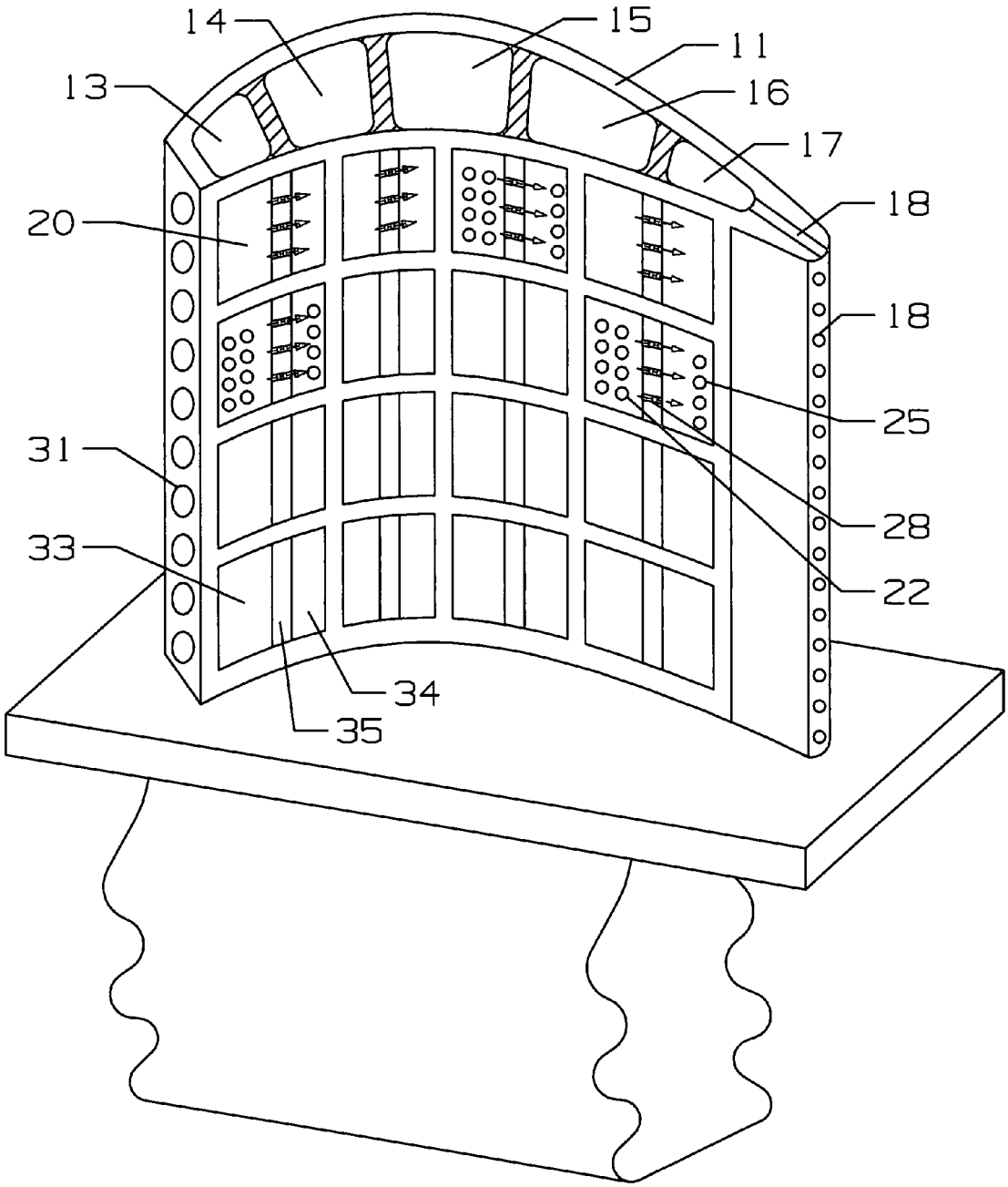
FIG. 6 shows a schematic view from the pressure side of the spar of the present invention with the staggered array of cavities with metering and impingement holes and diffusion holes.

FIG. 6 shows a schematic view of the turbine blade spar 11 on the pressure side. The blade structure includes a spar 11 (which can be cast) extending from the platform with a pressure side wall and a suction side wall separated by ribs that define cooling air cavities or channels. A leading edge rib is formed on the forward end and includes a row of impingement holes 31. A cooling air supply cavity 13 is formed behind the leading edge impingement holes 31. Ribs extending from the side walls of the spar, form collector cavities 14, 15, 16 and 17 as seen in FIG. 6. A row of exit cooling holes 18 are located in the trailing edge of the airfoil and connect the trailing edge cavity 17 to the exterior of the airfoil. On the sides of the spar is formed an array of modules 20 formed by vertical extending ribs and horizontally extending ribs. Each module is separated by a vertical extending rib 35 that separates the module into an impingement compartment 33 and a diffusion compartment 34. The spanwise extending ribs located within the walls of the spar that extend between the pressure side and suction side walls are aligned with the vertical extending separation ribs 35 of the modules 20 for reasons described below.

Figure 1:
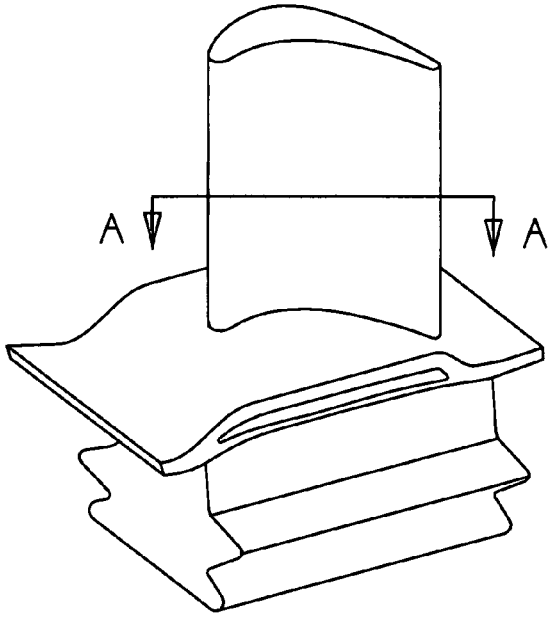
FIG. 1 shows a schematic view of a prior art turbine blade.
Figure 2:
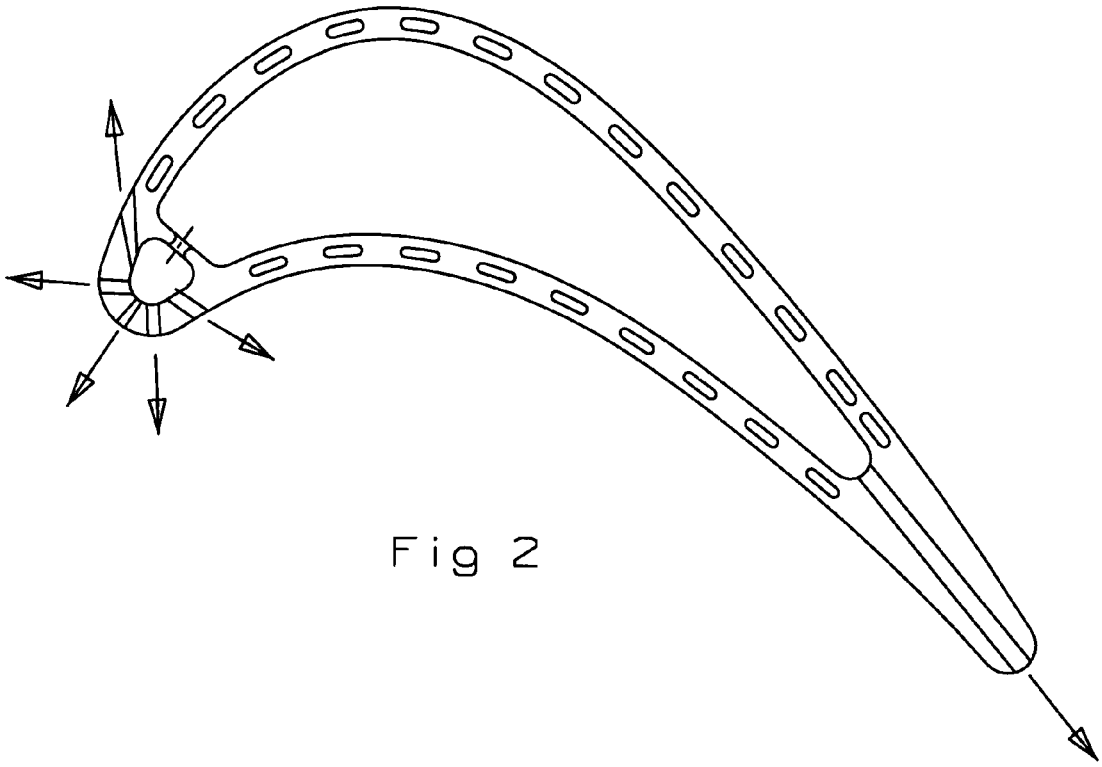
FIG. 2 shows a cross section top view of the prior art turbine blade cooling channels.
Figure 4:
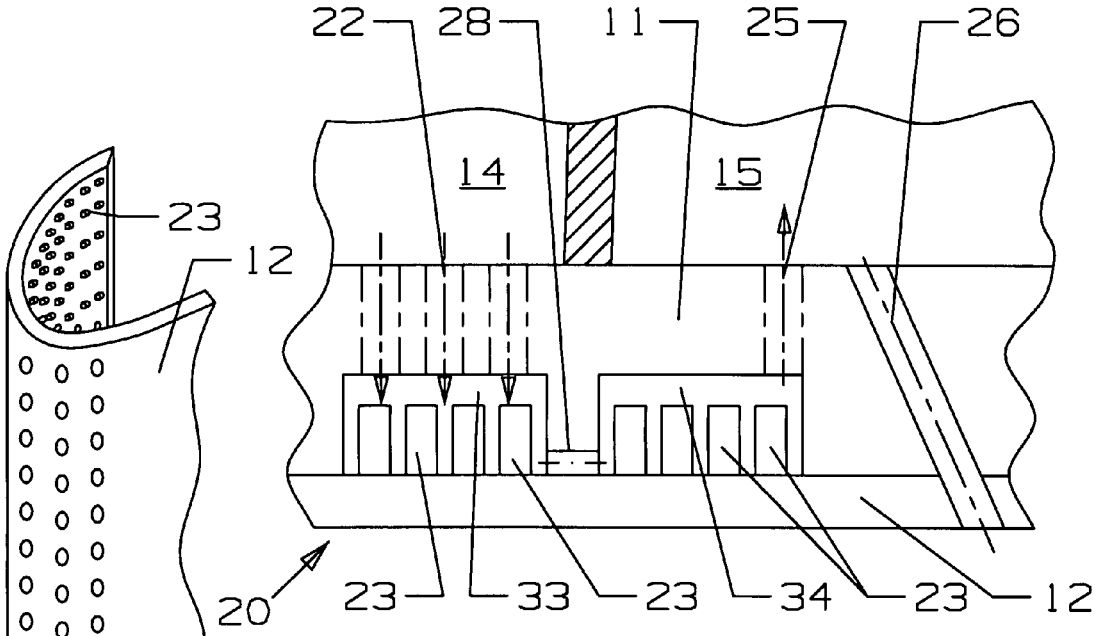
FIG. 4 shows a cross section view from the top of the spar with a cavity of the present invention.

Each impingement compartment 33 is connected to the cooling air supply channel by a plurality of metering and impingement holes 22. The vertical separation ribs 35 each include a plurality of cross-over holes 28 to connect the impingement compartment 33 to the diffusion compartment 34. Each diffusion compartment 34 includes a plurality of spent air return holes 25 connected to the collector cavity within the walls of the spar. FIG. 4 shows a cross section view from the top of one of the modules 20 located on the pressure side wall of the airfoil. The inner surface of the airfoil wall 11 forms the cooling air supply channel and includes three impingement holes 22 connecting the cooling supply channel to the impingement compartment 21 of the module 20. The arrows represent the cooling air flow through the impingement holes 22. A row of four micro pin fins 23 extend from the thin thermal skin 12 and into the impingement compartment 33, ending before the back surface where the impingement holes 22 open into the compartment 33. One cross-over hole 28 is shown extending along the airfoil chordwise direction and connecting the impingement compartment 33 to the diffusion compartment 34. The diffusion compartment 34 also includes a row of four micro pin fins 23 extending from the thin thermal skin 12 and into the diffusion compartment 34. The spent air return hole 25 connects the diffusion compartment 34 to the return or collector cavity 14 formed within the spar. Adjacent to the module in FIG. 4 is a film cooling hole 26 connecting the collector cavity 14 to the pressure side wall of the airfoil. In some situations, the spent air is discharged form the airfoil instead of passing into the next module located in the downstream direction of the cooling air flow. This discharge is accomplished by the use of film cooling holes 26.

Figure 5:
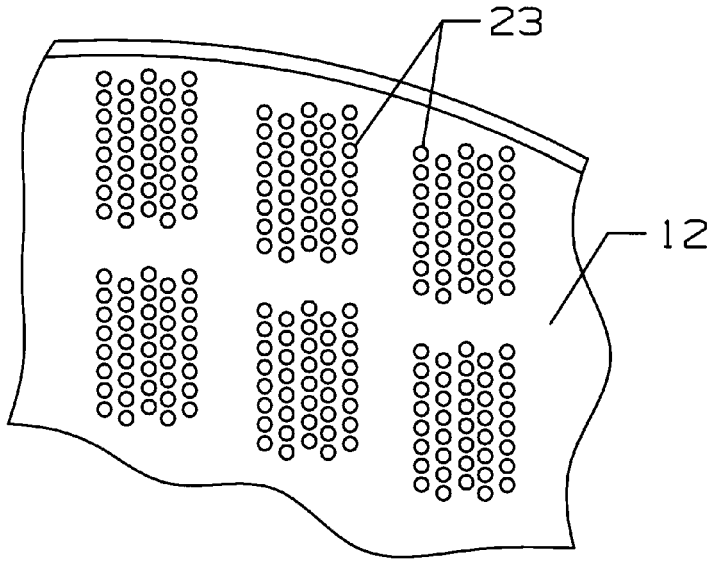
FIG. 5 shows an inner side view of the thermal skin of the present invention with the micro pin fins extending from the inner surface of the skin.

The thin thermal skin 12 used to cover the airfoil spar 11 along the pressure and suction sides and the leading edge of the airfoil forms the airfoil surface of the blade or vane. An array of micro pin fins 23 are formed on the inner surface of the thermal skin 12 with a grid of vertical and horizontal smooth surfaces for contact and bonding to the ribs on the airfoil spar as seen in FIG. 5. The airfoil spar 11 can be cast with a built-in mid chord cooling supply cavity. The multiple impingement cooling holes and leading edge backside impingement holes can be machined or cast into the first diffusion cavity and the leading edge spar piece. The thermal skin 12 with the micro pin fins 23 on the back side is formed from a different material or from the same material as the spar piece. The thermal skin is bonded to the ribs of the spar by a transient liquid phase (TLP) bonding process. The thermal skin 12 can be a single piece extending along both sides of the airfoil and the leading edge, or can be made of multiple piece in both the chordwise and spanwise directions of the airfoil. The thermal skin 12 can be a high temperature resistant material in a thin sheet metal form. The micro pin fins 23 can be formed by means of photo etching or electric discharge machining process onto the backside of the skin. The thickness of the thin skin 12 after etching can be in the range of 0.010 inches to 0.020 inches. The micro pin fin diameter and height will be in the approximate same order as the thickness of the thermal skin. The density of the pin fins can be in the range of 50 to 90 percent.

Figure 7:
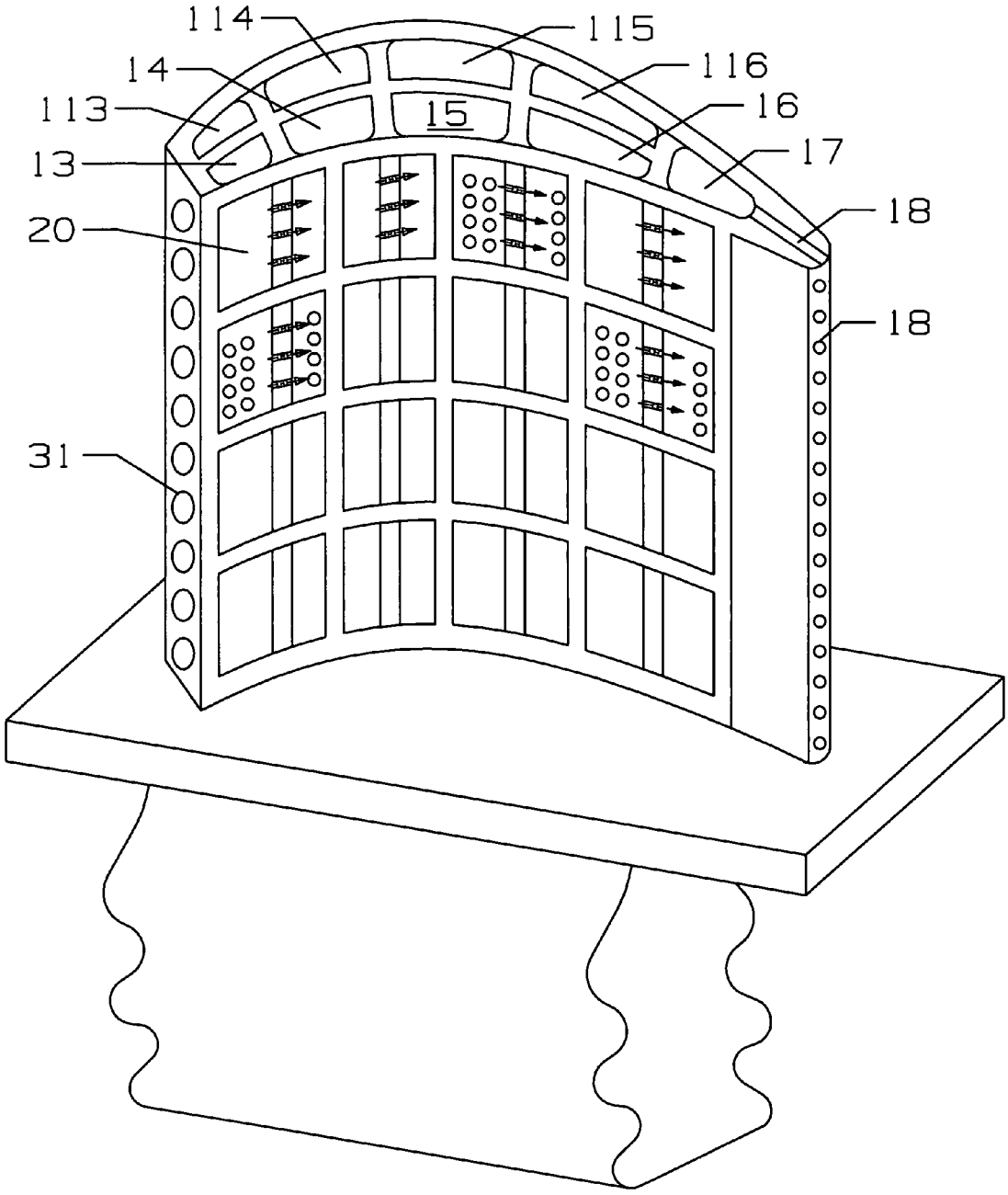
FIG. 7 shows a schematic view of a second embodiment of the present invention.

FIG. 7 shows a variation of the airfoil of FIG. 6 in that the modules on the pressure side and separated from the modules on the suction side by a chordwise extending rib that separates the cavities in the spar. The modules on the pressure side are supplied with cooling air from a separate cooling supply channel than are the modules on the suction side of the airfoil. With this embodiment, the cooling air supply pressure for the pressure side modules can be different than the pressure for the suction side modules. The pressure side includes a cooling air supply channel 13 followed by collector cavities 14, 15 and 16. The suction side includes a cooling supply channel 113 followed by collector cavities 114, 115 and 116. A common trailing edge collector cavity 17 is common for both sides of the airfoil. The leading edge rib impingement cooling holes 31 can be connected to the pressure side supply channel 13 or the suction side supply channel 113.

The operation of the cooling air passages in the first embodiment of FIG. 6 is as follows. Pressurized cooling air is supplied to the leading edge cooling supply channel 13 positioned along the leading edge region of the airfoil. Cooling air from channel 13 flows either through one of the row of leading edge impingement holes 31 formed in a leading edge rib of the spar and into the leading edge cavity of the airfoil formed between the leading edge spar and the thermal skin 12, or through one of the impingement holes 22 of the modules 20 and into the impingement compartment 33. Cooling air that flows through the leading edge impingement holes 31 with provide impingement cooling for the backside of the leading edge of the thin skin 12 to provide backside convection cooling for the leading edge. The pin fins 23 on the leading edge inner surface of the skin will increase the convective cooling. Showerhead film cooling holes 27 are formed in the thermal skin 12 around the leading edge to provide film cooling. Cooling air that flows through the impingement holes 22 and into the impingement compartments 33 impinge onto the backside surface of the thermal skin 12 and provide backside convective cooling to the airfoil wall. The cooling air passes through the micro pin fins 23 to produce additional cooling for the thin skin 12. The impingement cooling air then passes through the cross-over holes 28 and into the diffusion compartment 34 of the module 20 and then through the spent air return holes 25 and into the collector cavity 14. If required, film cooling holes 26 on the pressure or suction sides of the thermal skin 12 can be used to discharge film cooling air from any collector cavity and onto the surface of the airfoil wall.

From the collector cavity 14, the cooling air then flows through the impingement holes 22 of the next module 20 and the process through the module described above is repeated. The cooling air passes from collector cavity and into the next modules and back into the next downstream collector cavity until the cooling air flows into the trailing edge collector cavity 17. The cooling air then flows out through the row of trailing edge cooling holes 18 spaced along the trailing edge of the airfoil.

In the FIG. 7 embodiment, the leading edge supply channel is formed of a pressure side leading edge supply channel 13 and a suction side leading edge supply channel 113 so that the pressure of the cooling air can vary from the pressure side to the suction side. The pressure side includes collector cavities 14, 15, and 16, and the suction side includes collector cavities 114, 115, and 116 on the respective sides of the airfoil. The modules located on the pressure side are supplied with cooling air from the pressure side leading edge supply channel and discharge the spend air into the collector cavities 14, 15, and 16 also located on the pressure side. The modules on both sides of the airfoil finally discharge the spent cooling air into one common trailing edge collector cavity 17 in order to discharge the spent air out from the airfoil through the trailing edge exit holes 18.

In a variation of both FIG. 6 and FIG. 7 embodiments, the collector cavity 15 in the mid-chord region of the airfoil could be a second cooling air supply channel. In this variation, the spent air from the diffusion compartment 34 that would normally discharge into the collector cavity 15 would be discharged through film cooling holes onto the surface of the thermal skin. Or, the collector cavity 15 could be divided by a rib to form a collector cavity 15*a* and a supply channel 15*b* in which the diffusion compartment would discharge spent cooling air through the holes 25 and into the collector cavity 15*a*, and then discharge the spent cooling air through film cooling holes 26 onto the airfoil surface. The pressurized cooling air from the second supply channel 15*b* would flow into the impingement holes 22 of the modules located downstream from the collector cavity 15*a*. in this embodiment, the first cooling air supply channel 13 would deliver cooling air to a series of modules and discharge the cooling air from the downstream-most diffusion compartment through film cooling holes onto the thermal skin or into collector cavity 15*a* and then through film cooling holes. The second cooling supply channel 15*b* would deliver cooling air to the remaining modules downstream from the first set of modules supplied by the first cooling air supply channel. The second set of modules would discharge the cooling air from the last diffusion compartment into the trailing edge collector cavity and be discharged out through the trailing edge exit cooling holes 18. With this embodiment, the cooling air supply pressure for the second set of modules could be better controlled.

I claim the following:

1. An air cooled turbine airfoil for use in a gas turbine engine, the turbine airfoil comprising:

a support spar having an airfoil shape with a pressure side and a suction side and a trailing edge;

a plurality of modules formed on the pressure side of the support spar, each module having an impingement compartment and a diffusion compartment separated by a compartment rib;

the compartment ribs having at least one crossover hole connecting the impingement compartment to the diffusion compartment;

a thermal skin secured onto the support spar to form the airfoil surface of the turbine airfoil;

a plurality of impingement holes connecting the impingement compartment to a first cavity formed within the spar; and, a plurality of spent air return holes connecting the diffusion compartment to a second cavity formed within the spar, wherein cooling air flows from the first cavity in the spar through the impingement holes and into the impingement compartment to provide impingement cooling to the thermal skin, through the crossover hole and into the diffusion compartment, and then into the second cavity.

2. The air cooled turbine airfoil of claim 1, and further comprising:

a spar rib extending from the pressure side wall of the spar at about the location of the compartment rib in the module.

3. The air cooled turbine airfoil of claim 1, and further comprising:

a leading edge rib with a row of impingement cooling holes to provide impingement cooling for the leading edge of the airfoil; and, the thermal skin wrapped around the spar to form a leading edge cavity between the thermal skin and the leading edge rib.

4. The air cooled turbine airfoil of claim 1, and further comprising:

the thermal skin includes a plurality of micro pin fins extending into the impingement compartment.

5. The air cooled turbine airfoil of claim 4, and further comprising:

the thermal skin also includes a plurality of micro pin fins extending into the diffusion compartment.

6. The air cooled turbine airfoil of claim 1, and further comprising:

a plurality of modules extending along the airfoil pressure side from the leading edge impingement rib to the trailing edge region;

a cooling air supply channel located adjacent to the leading edge impingement rib;

a plurality of cavities extending from the cooling air supply channel to the trailing edge region, each cavity being separated by a rib;

a row of cooling air exit holes connected to the cavity adjacent to the trailing edge region; and, the modules being connected in series so that cooling air flows from one module to the next module through the cavity adjacent to both modules.

7. The air cooled turbine airfoil of claim 6, and further comprising:

the plurality of modules extends from the platform to the tip of the airfoil.

8. The air cooled turbine airfoil of claim 7, and further comprising:

the plurality of modules is arranged in a rectangular array.

9. The air cooled turbine airfoil of claim 1, and further comprising:

each module is rectangular in shape.

10. The air cooled turbine airfoil of claim 1, and further comprising:

a plurality of modules formed on the suction side of the support spar; and, adjacent modules on the pressure and suction sides of the support spar being connected to the same cavity.

11. The air cooled turbine airfoil of claim 1, and further comprising:

a plurality of modules formed on the suction side of the support spar; and, a chordwise extending rib separating the pressure side modules from the suction side modules such that cooling air passing through a pressure side module does not mix with cooling air passing through a suction side module with the exception of the trailing edge cavity.

12. The air cooled turbine airfoil of claim 3, and further comprising:

the cooling air supply channel supplies cooling air through the impingement holes in the leading edge support rib and in the impingement compartment to provide impingement cooling to the thermal skin.

13. The air cooled turbine airfoil of claim 1, and further comprising:

a film cooling holes connecting one of the cavities to the external surface of the thermal skin to provide film cooling, the film cooling hole bypassing the module.

14. The air cooled turbine airfoil of claim 1, and further comprising:

the thin skin having an impingement side with a plurality of micro pin fins formed thereon.

15. The air cooled turbine airfoil of claim 14, and further comprising:

the thermal skin has a thickness in the range of 0.010 to 0.020 inches, and the pin fins having a height or diameter in the range of 0.010 to 0.020 inches.

16. The air cooled turbine airfoil of claim 15, and further comprising:

the pin fins have a height and diameter in the range of 0.010 to 0.020 inches.

* * * * *